US009297170B1

(12) United States Patent
Jones

(10) Patent No.: US 9,297,170 B1
(45) Date of Patent: Mar. 29, 2016

(54) PLASTIC FILLER FINISHER

(71) Applicant: Michael A. Jones, Elgin, IL (US)

(72) Inventor: Michael A. Jones, Elgin, IL (US)

( * ) Notice: Subject to any disclaimer, the term of this patent is extended or adjusted under 35 U.S.C. 154(b) by 48 days.

(21) Appl. No.: 13/999,084

(22) Filed: Jan. 10, 2014

Related U.S. Application Data

(60) Provisional application No. 61/848,796, filed on Jan. 11, 2013.

(51) Int. Cl.
*E04F 21/16* (2006.01)
*E04F 21/165* (2006.01)

(52) U.S. Cl.
CPC ..... *E04F 21/1655* (2013.01)

(58) Field of Classification Search
CPC ..... E04F 21/16; E04F 21/165; E04F 21/1652
See application file for complete search history.

(56) References Cited

U.S. PATENT DOCUMENTS

| | | | | | |
|---|---|---|---|---|---|
| 2,188,114 | A | * | 1/1940 | Hubbard | A47L 13/08 15/105 |
| 3,058,139 | A | * | 10/1962 | Dryden | 15/244.1 |
| 4,211,501 | A | * | 7/1980 | Pedroso et al. | 401/261 |
| D343,559 | S | * | 1/1994 | Liberty | D8/45 |
| 5,351,356 | A | * | 10/1994 | Townsend, Jr. | 15/114 |
| 5,908,644 | A | * | 6/1999 | Poole | 425/458 |

OTHER PUBLICATIONS

Hawley, G.G., The Condensed Chemical Dictionary, Tenth Edition, Van Nostrand Reinhold Company Inc., New York, N.Y., 1981, pp. 2 and 22.

* cited by examiner

*Primary Examiner* — Shay Karls
(74) *Attorney, Agent, or Firm* — Christopher John Rudy

(57) ABSTRACT

Tool for finishing a plastic filler includes an elongate member having a first end and an opposing second end; on the first end of the member is an absorbent/adsorbent structural component; and on the second end of the member is a spatula blade. The elongate member may have a stabilizing contrivance for the absorbent/adsorbent structural component and/or spatula blade. The spatula blade may have a laterally extending rib.

20 Claims, 2 Drawing Sheets

PLASTIC FILLER FINISHER

This claims the benefits under 35 USC 119(e) of application No. U.S. 61/848,796 filed on Jan. 11, 2013 A.D. Its entire specification is incorporated herein by reference.

FIELD AND PURVIEW OF THE INVENTION

This concerns a tool for finishing a plastic filler. The tool, in general, includes an elongate member, with an absorbent/adsorbent structural component, for example, a sponge, on one end; and a spatula blade on the other end. The elongate member itself may be of concern.

BACKGROUND TO THE INVENTION

Applying caulk so as to have effective sealing properties as well as a nice looking finish is a difficult endeavor, often thought of in layman's terms as more of an art than a science, not uncommonly a messy and unhappy job. A common procedure is to lay the bead from a caulk gun, and then finish it, often with only a wet finger. This procedure can leave uniformity at a loss, and, moreover, can be unpleasant, if not hazardous, as the composition may work upon or react with the flesh, and such things as splinters, nail heads and so forth can lacerate the finger moving over the bead or line of caulk. Those who can effectively finish caulk lines and make them look good consistently are expert workmen having much in the way of talent and experience.

Likewise, applying grout effectively to tile is not a job for an average layman. It, too, has pitfalls and dangers related to the materials employed and so forth.

It would be desirable to enable those of more common talent and less experience than such experts to effectively finish caulk, tile grout, and so forth and make it look good consistently. It would be desirable, too, to provide for an avoidance of such unpleasant if not hazardous things as mentioned above. It would be desirable to provide the art an alternative.

A FULL DISCLOSURE OF THE INVENTION

Provided hereby is a tool for finishing a plastic filler. The tool comprises an elongate member having a first end and an opposing second end; on the first end of the member is an absorbent/adsorbent structural component; and on the second end of the member is a spatula blade. The elongate member may have a stabilizing contrivance for the absorbent/adsorbent structural component and/or spatula blade. Provided hereby also is a ribbed paddle itself or for the elongate member with or without an absorbent member.

The invention is useful in construction and repair.

Significantly hereby, the art is advanced in kind. Notably, the invention enables those of more common talent and less experience than expert workmen to effectively finish caulk, tile grout, and so forth and make it look good consistently. Whereas other finishing tools would require lifting it from a bead of caulk, adjusting it and replacing it on the bead, or placing another portion of the tool on the bead, now one tool, the present plastic filler finisher, can be used with a single, simple twist of the wrist on-the-fly to switch angles and widths of a bead or line of a plastic filler, for example, caulk, with its spatula blade staying in contact with the plastic filler. And, unlike other known caulk finishing tools on the market, many if not most of which need to be operated orthogonally to the bead or line, the present plastic filler finisher can be operated effectively at nearly any angle. Moreover, its absorbent/adsorbent structural component, made to carry a diluent or solvent compatible with that found in the plastic filler, can be used quickly to go-in-behind the bead and finish it to an ultra smooth finish, more fine than heretofore known with other caulk finishing tools. It can be provided in any of a variety of useful sizes, surface shapes and angles. It can provide, moreover, for the sure and certain finishing of caulk beads or lines of various widths, and those of tile grout, or even concrete beads or other cementitious formable materials, adhesives, other formable organic resins, and so forth. It provides for an avoidance of such unpleasant if not hazardous things as caulk or grout being in longstanding contact with the finger, and avoidance of such things as splinters, nail heads, abrasive fine aggregates, and so forth. The present plastic filler finisher is reliable and pleasant to use. It may be provided in disposable form or a form in which worn or used components can be replaced. It can be efficient to manufacture.

Numerous further advantages attend the invention.

The drawings form part of the specification hereof. With respect to the drawings, which are not necessarily drawn to scale, the following is briefly noted:

The invention can be further understood with reference to the detail set forth below. The same, as with the foregoing, is to be taken in an illustrative and not necessarily limiting sense.

The present plastic filler finisher and its various components may be provided in any suitable size and shape, and made with any suitable material. Thus, the elongate member may be in a form of a shaft, which may have a cross-section that is round, elliptical, oval, triangular, square, rectangular, and so forth, and be made of plastic, rubber, metal, wood, or wound or stiffened paper, and so forth, which may be stiff or resilient yet with enough stiffness to be able to wield it and control its attached spatula and absorbent/adsorbent structural components, and which may advantageously be inert to or lowly-adhering of the plastic filler, for example, being made of a silicone-containing solid plastic resin. The absorbent/adsorbent structural component may be in a form of a cap-like contrivance, say, akin to a mushroom cap, which may be generally cylindrical with a rounded tip, and which may be provided with a sleeve for slideably mounting on the elongate member, and may be made of a resilient textile or animal fiber felt such as of cotton or wool, a sponge, which may be a natural animal sponge or synthetic sponge such as made with a resilient, solid, foamed plastic resin, and so forth, which can absorb or otherwise retain a liquid such as water and/or an organic compound or mixture of compounds, for example, alcohol, paint thinner and/or mineral spirits, to assist in final finishing of the plastic filler. The spatula blade may be in a form of a flattened rectangular box, a rectangular box with semi-circular or semi-elliptical or semi-oval tip, an ellipse or oval, or be in another thickened polygon, curvilinear or curved shape, and may have a laterally extending rib, for example, on one or more side and tip portions of the spatula blade. The spatula blade may be made of a resilient, yet suitably stiff and controllable material such as a suitable solid plastic resin or rubber, say, a flexible, resilient silicone plastic. Corners or edges may be rounded on the elongate member, absorbent/adsorbent structural component and/or spatula blade for purposes of enhanced performance or increased comfort and ease of use even over a long period. The lateral rib provided with the spatula blade can provide for even more enhanced performance, for example, allowing finish caulking or grouting at a more, substantially narrow or more, substantially wide bead typically than without. The ribbed spatula blade can make for a stronger attachment to the elongate member.

Any suitable method may be employed to make the plastic filler finisher and its various components. Thus, molding, machining and/or gluing may be employed.

Figure 1:
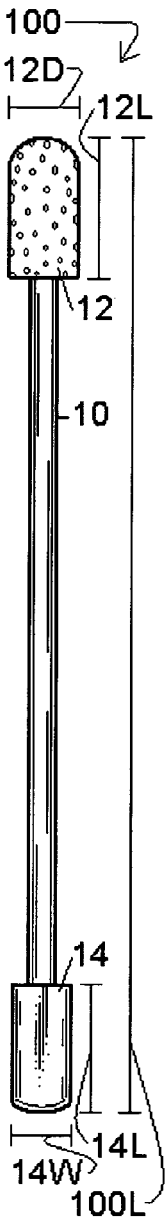
FIG. 1 is a first side view of a plastic filler finisher hereof, the opposing side able to be a mirror image whereof.
Figure 2:
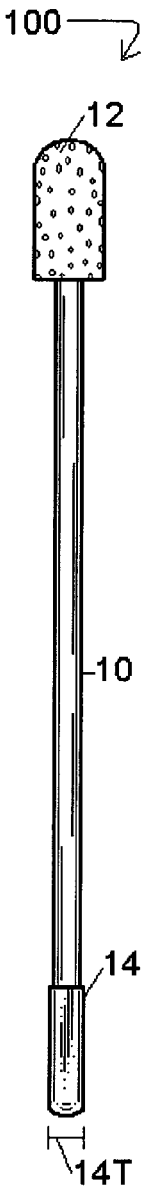
FIG. 2 is a second side view of the plastic filler finisher of FIG. 1, taken at 90° thereto, the opposing side able to be a mirror image whereof.
Figure 3:
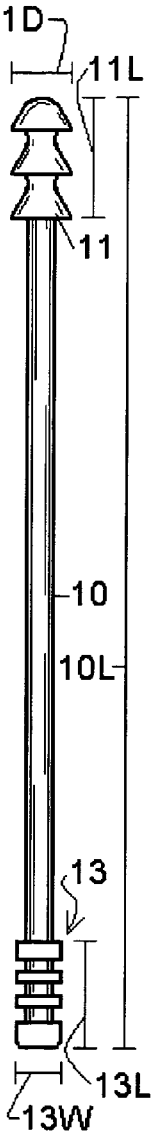
FIG. 3 is a first side view of the elongate member found within the plastic filler finisher of FIG. 1, taken in the same direction as the view of FIG. 1, with the opposing side able to be a mirror image whereof.
Figure 4:
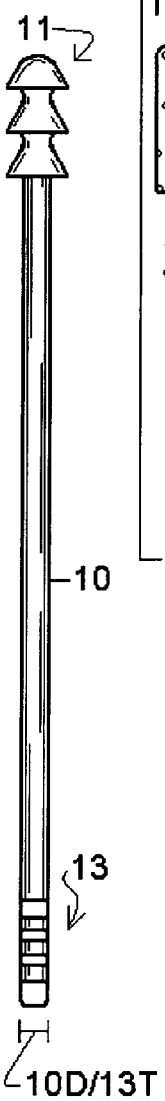
FIG. 4 is a second side view of the elongate member found within the plastic filler finisher of FIG. 1, taken in the same direction as the view of FIG. 2, with the opposing side able to be its mirror image.
Figure 5:
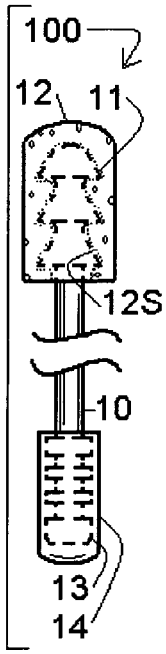
FIG. 5 is a first side, plan view of the plastic filler finisher of FIG. 1, taken in the same direction as the view of FIG. 1, with the opposing side able to be its mirror image.
Figure 6:
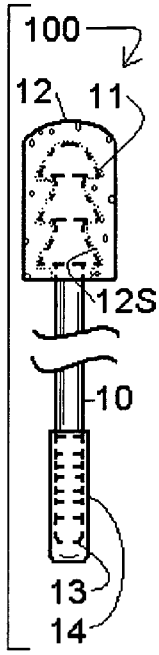
FIG. 6 is a second side, plan view of the plastic filler finisher of FIG. 1, taken in the same direction as the view of FIG. 2, with the opposing side able to be its mirror image.
Figure 7:
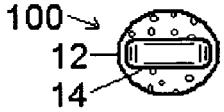
FIG. 7 is an end view of the plastic filler finisher of FIG. 1.
Figure 8:
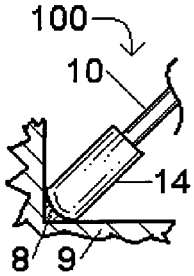
FIG. 8 is a view of the plastic filler finisher of FIG. 1 in use finishing caulk.
Figure 9:
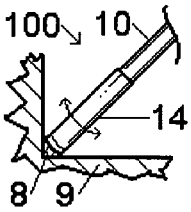
FIG. 9 is a view of the plastic filler finisher of FIG. 1 in use finishing caulk to have a more narrow bead than that depicted in FIG. 8.
Figure 10:
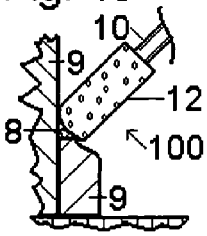
FIG. 10 is a view of the plastic filler finisher of FIG. 1 in use finishing caulk about a baseboard.
Figure 11:
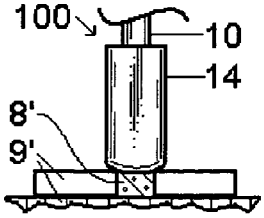
FIG. 11 is a view of the plastic filler finisher of FIG. 1 in use finishing tile grout.
Figure 12:
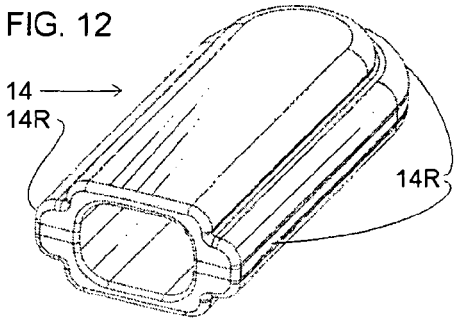
FIG. 12 is a perspective view of a ribbed spatula blade (ribbed paddle), which can be employed with an elongate member with or without an absorbent member to provide another embodiment of a plastic filler finisher.
Figure 13:
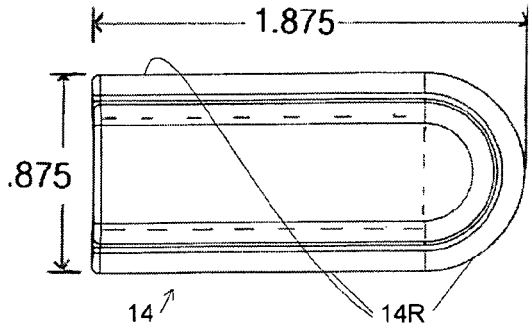
FIG. 13 is a top view of the ribbed paddle of FIG. 12.
Figure 14:
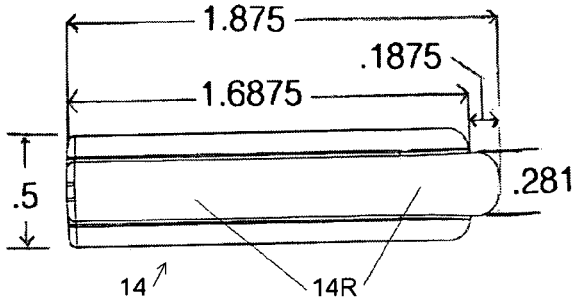
FIG. 14 is a side view of the ribbed paddle of FIG. 12.
Figure 15:
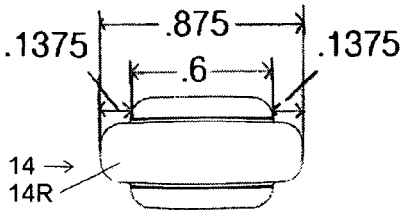
FIG. 15 is a front view of the ribbed paddle of FIG. 12, looking at its tip.
Figure 16:
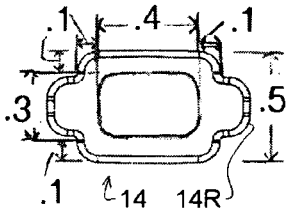
FIG. 16 is a rear view of the ribbed paddle of FIG. 12.

With reference to the drawings, the following is noted:

Plastic filler finisher tool 100, which may have any suitable overall length 100L, say, about from seven or ten to fourteen or seventeen inches, for example, about 12¾ inches, is for finishing a bead or line of plastic filler, for example, caulk 8 on structure 9 or grout 8' about tile and support structure 9', and includes elongate member 10, say, in a form of a generally cylindrical shaft of solid silicone plastic resin. The elongate member 10 may have any suitable dimensions, for instance, as a generally radially symmetric shaft, it may have any suitable shaft diameter 10D, say, about from 3/16 to ½ of an inch, for example, about 5/16 of an inch, and have any suitable length 10L, say, about from six or nine to 13¼ to 16¾ inches, for example, about 12⅜ inches. The elongate member 10 can include first stabilizing contrivance 11, say, in a form of a set of radially symmetrical barbs, the most distal of which may have a rounded cap, all provided monolithically as part of the elongate member 10; and have any suitable dimensions, for instance, diameter 11D, say, about from ¼ to ¾ of an inch, for example, about 7/16 of an inch, and any suitable length 11L, say, about from one inch to 1¾ inches, for example, about 1 5/16 inches. The first stabilizing contrivance 11 serves to hold absorbent/adsorbent structural component 12, for example, a supple, synthetic open foamed (gas in resilient solid) plastic, substantially cylindrical, generally hemispherical tipped cap; and the absorbent/adsorbent structural component 12 can have any suitable dimensions, for instance, diameter 12D, say, about from ½ of an inch to 1½ inches, for example, about ⅞ of an inch, and length 12L, say, about from 1¼ to three inches, for example, about 2⅛ inches. Sleeve 12S may be provided as a slit, bored-out cylinder, and so forth, for inserting the absorbent/adsorbent structural component 12 over the first stabilizing contrivance 11 so as to hold the absorbent/adsorbent structural component firmly, yet reversibly in place, with replacement of a worn or dirty absorbent/adsorbent structural component 12 able to be readily accomplished thereby. A string or rubber band (not illustrated) may be employed to further secure the absorbent/adsorbent structural component to the elongate member 10. The elongate member 10 can include second stabilizing contrivance 13, say, in a form of a set of opposing fingers, the most distal of which may embrace a rounded tip, all provided monolithically as part of the elongate member 10; and have any suitable dimensions, for instance, length 13L, say, about from one inch to 1¾ inches, for example, about 1 5/16 inches; thickness 13T, which may be essentially the same as the shaft diameter 10D; and width 13W, say, about from ¼ to ¾ of an inch, for example, about ½ of an inch. The second stabilizing contrivance 13 serves to hold spatula blade 14, for example, a solid, molded-on, non-foamed resilient plastic, substantially in a form of a rectangular box with a rounded tip and rounded corners; and the spatula blade 14 can have any suitable dimensions, for instance, length 14L, say, about from one to three inches, for example, about two inches; thickness 14T, say, about from 7/32 to ¾ of an inch, for example, about ⅜ of an inch; and width, say, about from ⅜ of an inch to 1¼ inches, for example, about ¾ of an inch. The spatula blade 14 may have laterally extending rib 14R to make the ribbed paddle, which can be molded in one piece as an integral unit, and such a more robust ribbed paddle, too, may have any suitable dimensions, such as the illustrative dimensions in inches, approximately or exactly, found in FIGS. 13-16.

Use of the plastic filler finisher tool 100 is quite simple. Generally, first a bead or line of the plastic filler, for illustrative examples, the caulk 8 or the grout 8', is placed over an appropriate portion of the structure 9, 9', say, along a corner or about a more planarly arrayed junction, and, grasping the tool 100 in any convenient place along its elongate member 10, for example, with a pencil-holding grip, the spatula blade 14 is pulled into and across the bead or line of the plastic filler, say again, the caulk 8 or tile grout 8', simultaneously forcing the tip of the spatula blade 14 against the surfaces of the structure 9, 9' to make a first pass. A wide finished bead or line of the plastic filler, for an illustrative example, the caulk 8, can be provided by keeping the spatula blade width 14W substantially perpendicular to the bead or line; a narrow finished bead or line of the caulk 8, one in which less of the caulk 8 is employed, of course, than in the wide finished bead or line, by keeping the spatula blade thickness 14T substantially perpendicular to the bead or line (with, of course, the spatula blade width 14W being substantially parallel to the bead or line); and finished beads or lines of the caulk 8 intermediate in dimensions to the wide and narrow beads or lines by holding the spatula blade width 14W (and, of course, thickness 14T) at an angle between that of perpendicular to and parallel with the bead or line. A simple twist-on-the-fly rotation of the spatula blade 14 with or without rib 14R, which can be done through a quick twist of an elongate member 10 attached thereto, suffices to quickly change the width of the bead or line. The tool 100 in generally can work most effectively at nearly any angle at which it is held. After the first pass, or alternatively without there having had been a first pass with the spatula blade 14 at all, a second pass across the bead or line, similar in operation to the first pass, can be made with the absorbent/adsorbent structural component 12. Prior to the second pass, and, although less desirable from an aesthetic standpoint, intermittently during the pass if need be, the absorbent/adsorbent structural component 12 may be moistened with a diluent such as water or a non-aqueous organic liquid or liquid composition, which would be determined to be compatible with finishing the plastic filler, again, for an illustrative example, the caulk 8. This simple and close-in-time, go-in-behind action can provide for the finer finish obtainable with the present tool 100. The final finish thus obtained hereby may often be an ultra smooth finish, more fine than heretofore obtained with other tools or methods. Any clean-up may employ suitable rags, towels, and diluents. Other plastic fillers may be finished in the same or in a suitable, analogous manner. Replacement of worn or dirty components, for example, the absorbent/adsorbent structural component 12, may be carried out during clean-up time or as needed during the plastic filler-finishing operations themselves.

Any suitable plastic filler may be finished with the plastic filler finisher tool, to include the tool 100, the plastic filler being a material that is capable of being formed, molded or modeled when in a liquid, typically of high viscosity, or semisolid state. Thus, as mentioned above, a plastic filler such as the caulk 8 or the grout 8' can be finished. Other examples of the plastic filler include uncured, wet concrete or another cementitious formable material, a curable or curing liquid or semisolid adhesive, tar, roofing cement, another formable liquid or semisolid organic resin, and so forth and the like.

A spatula blade 14, especially with the rib 14R, may be mounted or not, and used. Advantageously, however, as with the plastic filler finishing tool 100, it is mounted to a second end of an elongate member such as the member 10, preferably with an absorbent/adsorbent structural component such as the component 12 mounted to an opposing first end of the elongate member such as the member 10.

CONCLUSION TO THE INVENTION

The present invention is thus provided. Various feature(s), part(s), subcombination(s) and/or combination(s) can be employed with or without reference to other feature(s), part(s), subcombination(s) and/or combination(s) in the practice of the invention, and numerous adaptations and modifications can be effected within its spirit, the literal claim scope of which is particularly pointed out as follows:

What is claimed is:

1. A tool for finishing a plastic filler, which comprises an elongate member having a first end and an opposing second end; on the first end of the member an absorbent/adsorbent structural component; and on the second end of the member a spatula blade—wherein:

the absorbent/adsorbent structural component:

includes a generally cylindrical body, which is axially directed with respect to the elongate member, and surmounted with a rounded, generally hemispherical tip; and can absorb or otherwise retain a liquid to assist in final finishing of the plastic filler;

the spatula blade:

includes a generally flattened body surmounted with a tip that is generally flattened and rounded when viewed from a top position, the body having generally rounded sides when when viewed from a position taken in a direction along the elongate member, and tip having generally rounded sides and extremity when viewed from a position perpendicular to the view taken from the top position; and is flexible and resilient; and the tool is useful for finishing the plastic filler.

2. The tool of claim 1, wherein the elongate member has a stabilizing contrivance for the absorbent/adsorbent structural component and/or spatula blade.

3. The tool of claim 2, wherein the spatula blade is of substantial thickness and is substantially U-shaped when viewed from the top position.

4. The tool of claim 3, wherein the spatula blade includes a laterally extending rib on opposing side and tip portions of the spatula blade protruding from and along the sides of the generally flattened body, which is rounded when viewed from the position taken in a direction along the elongate member, and protruding from and along the sides and extremity of the tip, which is rounded when viewed from the position perpendicular to the view taken from the top position, and the rib is substantially U-shaped when viewed from the top position.

5. The tool of claim 4, wherein the absorbent/adsorbent structural component is a synthetic sponge made with a supple, synthetic open foamed plastic resin.

6. The tool of claim 3, wherein the absorbent/adsorbent structural component is a synthetic sponge made with a supple, synthetic open foamed plastic resin.

7. The tool of claim 2, wherein the absorbent/adsorbent structural component is a synthetic sponge made with a supple, synthetic open foamed plastic resin.

8. The tool of claim 1, wherein the spatula blade is of substantial thickness and is substantially U-shaped when viewed from the top position.

9. The tool of claim 8, wherein the spatula blade includes a laterally extending rib on opposing side and tip portions of the spatula blade protruding from and along the sides of the generally flattened body, which is rounded when viewed from the position taken in a direction along the elongate member, and protruding from and along the sides and extremity of the tip, which is rounded when viewed from the position perpendicular to the view taken from the top position, and the rib is substantially U-shaped when viewed from the top position.

10. The tool of claim 9, wherein the absorbent/adsorbent structural component is a synthetic sponge made with a supple, synthetic open foamed plastic resin.

11. The tool of claim 8, wherein the absorbent/adsorbent structural component is a synthetic sponge made with a supple, synthetic open foamed plastic resin.

12. The tool of claim 1, wherein the absorbent/adsorbent structural component is a synthetic sponge made with a supple, synthetic open foamed plastic resin.

13. The tool of claim 1, wherein the absorbent/adsorbent structural component is about from ½ of an inch to 1½ inches in diameter, and about from 1¼ to 3 inches in length; the spatula blade is about from 1 to 3 inches in length, about from 7/32 to ¾ of an inch in thickness, and about from ⅜ of an inch to 1¼ inches in width; and the tool is about from 7 to 17 inches in length.

14. The tool of claim 13, wherein the absorbent/adsorbent structural component is about ⅞ of an inch in diameter, and about 2⅛ inches in length; and the tool is about from 10 to 14 inches in length.

15. A tool for finishing a plastic filler, which comprises a flexible, resilient spatula blade of substantial thickness having:

top and opposing bottom faces, with which is associated the thickness;

two opposing side faces, with which is associated a width; and a rear and an opposing tip, with which is associated a length;

wherein:

the spatula blade includes a laterally extending rib on the opposing side faces and tip, which protrudes from and along the side faces of the spatula blade, which is rounded when viewed in a lengthwise direction; protrudes from and along sides and extremity of the tip, which is rounded when viewed in the lengthwise direction and a widthwise direction; and is substantially U-shaped when viewed in a thickness-wise direction; and the tool is useful for finishing a plastic filler.

16. The tool of claim 15, wherein the spatula blade is attached to a second end of an elongate member that has first and second opposing ends.

17. The tool of claim 16, wherein an absorbent/adsorbent structural component is attached to the first end of the elongate member.

18. The tool of claim 15, wherein a lengthwise blind hole is provided in the rear end of the spatula blade.

19. The tool of claim 15, wherein the spatula blade is about from 1 to 3 inches in length, about from 7/32 to 3/4 of an inch in thickness, and about from 3/8 of an inch to 1 1/4 inches in width.

20. The tool of claim 19, wherein the spatula blade is about 1.6875 inches in length and about 1 7/8 inches in length including the rib, about 1/2 of an inch in thickness about a central portion, and about 0.6 of an inch in width and 7/8 of an inch in width including the rib, with the rib about 0.3 of an inch in thickness.

* * * * *